United States Patent [19]

Komiya

[11] 4,320,692

[45] Mar. 23, 1982

[54] RADIAL CYLINDER HYDRAULIC MOTOR

[75] Inventor: Morio Komiya, Kawasaki, Japan

[73] Assignee: Kayaba Kogyo Kabushiki Kaisha, Tokyo, Japan

[21] Appl. No.: 141,856

[22] Filed: Apr. 21, 1980

[30] Foreign Application Priority Data

Apr. 27, 1979 [JP] Japan ..... 54-52229

[51] Int. Cl.[3] ..... F01B 13/06; F04B 1/30

[52] U.S. Cl. ..... 91/497

[58] Field of Search ..... 91/497; 417/218, 221

[56] References Cited

U.S. PATENT DOCUMENTS

| | | | |
|---|---|---|---|
| 2,404,175 | 7/1946 | Holden et al. | 417/221 |
| 2,709,408 | 5/1955 | Orshansky | 91/497 X |
| 3,828,400 | 8/1974 | Mason et al. | 91/497 |
| 3,908,517 | 9/1975 | Wenbourne | 91/497 |
| 4,195,553 | 4/1980 | Klie | 91/497 |

*Primary Examiner*—Michael Koczo, Jr.
*Attorney, Agent, or Firm*—David G. Alexander

[57] ABSTRACT

An annulus (19) is integrally rotatable with a shaft (13). First and second pistons (22), (23) are disposed between the shaft (13) and the annulus (19) in diametrically opposed relation. A plurality of pistons (17) are circumferentially spaced around the annulus (19) and are sequentially supplied with high pressure hydraulic fluid to exert driving force on the annulus (19) and shaft (13) in proportion to the eccentricity of the annulus (19). High pressure fluid is selectively applied to one of the first and second pistons (22), (23) to shift the annulus (19) and thereby vary the eccentricity thereof and the motor speed and torque. A pair of diametrically opposed, semicircular shoes (49), (51) are retained by the shaft (13) and movable perpendicular to a direction of movement of the first piston (22). An inner end of the first piston (22) is formed with a circular cutout (54). In response to high pressure applied to facing surfaces of the shoes (49), (51), the shoes (49), (51) move away from each other and abuttingly prevent the first piston (22) from moving closer to the shaft (13) beyond a limit position. In response to low pressure applied to the facing surfaces of the shoes (49), (51), the shoes (49), (51) move toward each other and fit inside the cutout (54). Thus, the first piston (22) is allowed to move closer to the shaft (13) than the limit position. This arrangement provides a three speed radial cylinder hydraulic motor (41).

5 Claims, 8 Drawing Figures

RADIAL CYLINDER HYDRAULIC MOTOR

BACKGROUND OF THE INVENTION

The present invention relates to improvements to a radial cylinder hydraulic motor of the type disclosed in U.S. Pat. No. 3,828,400 which constitutes the closest known prior art and is incorporated herein by reference.

This type of motor comprises an annulus which is disposed around and integrally rotatable with a shaft. A plurality of pistons are circumferentially spaced around the annulus and are sequentially supplied with high pressure hydraulic fluid to exert driving force on the annulus and shaft in proportion to the eccentricity of the annulus. First and second pistons are disposed in diametrically opposed relation between the shaft and annulus. High pressure fluid is selectively applied to one of the first and second pistons to cause the same to move radially outwardly and vary the eccentricity of the annulus.

Although the motor functions in a satisfactory and efficient manner, it suffers from the drawback that it is capable of only two rotational speeds.

Although attempts have been made to variably position the first and second pistons and thereby the annulus by means of a servo mechanism and a fluid lock arrangement for the first and second pistons, these attempts have proven unsuccessful due to leakage from piston chambers resulting in displacement of the first and second pistons and annulus from the desired position.

SUMMARY OF THE INVENTION

A radial cylinder hydraulic motor embodying the present invention includes a shaft, an annulus integrally rotatable with the shaft, first and second pistons disposed between the shaft and the annulus in diametrically opposed relation, a plurality of pistons circumferentially spaced around the annulus in driving relation therewith and hydraulic control means for selectively applying hydraulic pressure to one of the first and second pistons to urge the same away from the shaft and thereby vary an eccentricity of the annulus relative to the shaft, and is characterized by comprising hydraulically actuated stop means disposed between the shaft and the first piston and being movable between a first position for abuttingly preventing movement of the first piston toward the shaft closer than a limit distance from the shaft and a second position for allowing movement of the first piston toward the shaft closer than the limit distance from the shaft. A radially inner end of the first piston is formed with a circular cutout, the stop means comprising a pair of diametrically opposed semicircular shoes which are movable perpendicular to a direction of movement of the first piston and hydraulic actuator means for selectively applying high hydraulic pressure and low hydraulic pressure to facing surfaces of the shoes, the shoes, in response to high pressure, moving away from each other to the first position in which a portion of the first piston outside the cutout abuttingly engages with the shoes and, in response to low pressure, moving toward each other to the second position in which the shoes fit inside the cutout.

In accordance with the present invention, an annulus is integrally rotatable with a shaft. First and second pistons are disposed between the shaft and the annulus in diametrically opposed relation. A plurality of pistons are circumferentially spaced around the annulus and are sequentially supplied with high pressure hydraulic fluid to exert driving force on the annulus and shaft in proportion to the eccentricity of the annulus. High pressure fluid is selectively applied to one of the first and second pistons to shift the annulus and thereby vary the eccentricity thereof and the motor speed and torque. A pair of diametrically opposed, semicircular shoes are retained by the shaft and movable perpendicular to a direction of movement of the first piston. An inner end of the first piston is formed with a circular cutout. In response to high pressure applied to facing surfaces of the shoes, the shoes move away from each other and abuttingly prevent the first piston from moving closer to the shaft beyond a limit position. In response to low pressure applied to the facing surfaces of the shoes, the shoes move toward each other and fit inside the cutout. Thus, the first piston is allowed to move closer to the shaft than the limit position. This arrangement provides a three speed radial cylinder hydraulic motor.

It is an object of the present invention to provide a radial cylinder hydraulic motor of the type disclosed in the above discussed United States patent which is capable of rotation in three or more speeds.

It is another object of the present invention to provide a generally improved radial cylinder hydraulic motor.

Other objects, together with the foregoing, are attained in the embodiments described in the following description and illustrated in the accompanying drawing.

DESCRIPTION OF THE PREFERRED EMBODIMENTS

While the radial cylinder hydraulic motor of the present invention is susceptible of numerous physical embodiments, depending upon the environment and requirements of use, substantial numbers of the herein shown and described embodiments have been made, tested and used, and all have performed in an eminently satisfactory manner.

Figure 1:
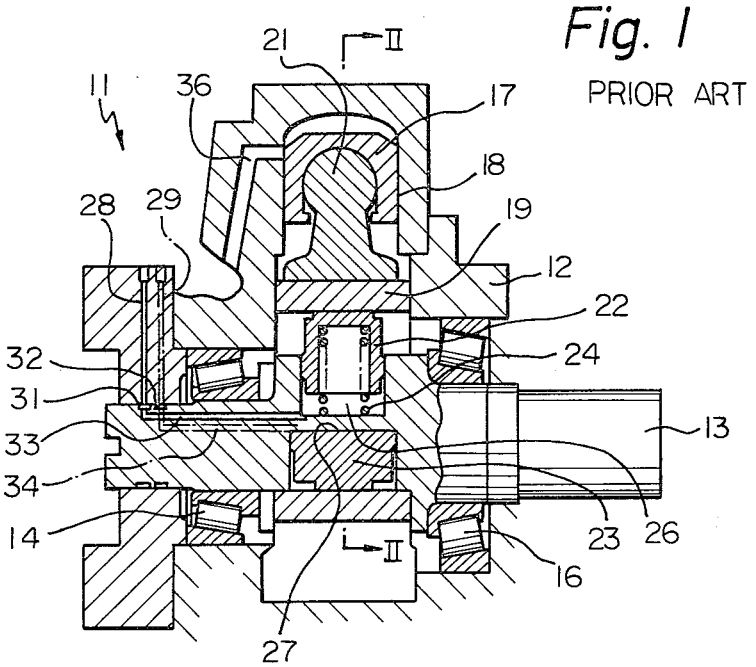
Fig. 1 PRIOR ART
FIG. 1 is a longitudinal sectional view of a prior art radial cylinder hydraulic motor.
Figure 2:
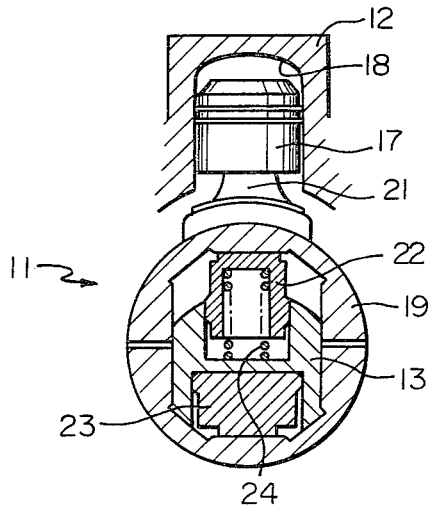
Fig. 2 PRIOR ART
FIG. 2 is a section taken on a line II—II of FIG. 1.
Figure 3:
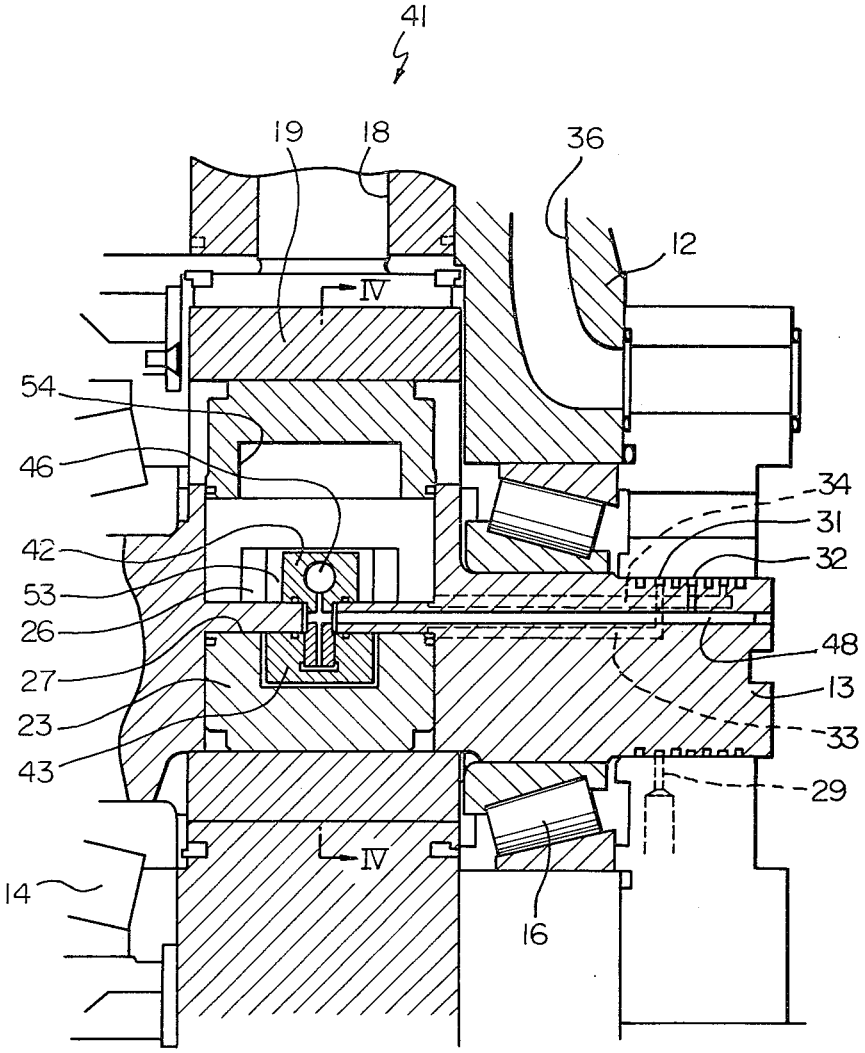
FIG. 3 is an enlarged longitudinal sectional view of a radial cylinder hydraulic motor embodying the present invention.
Figure 4:
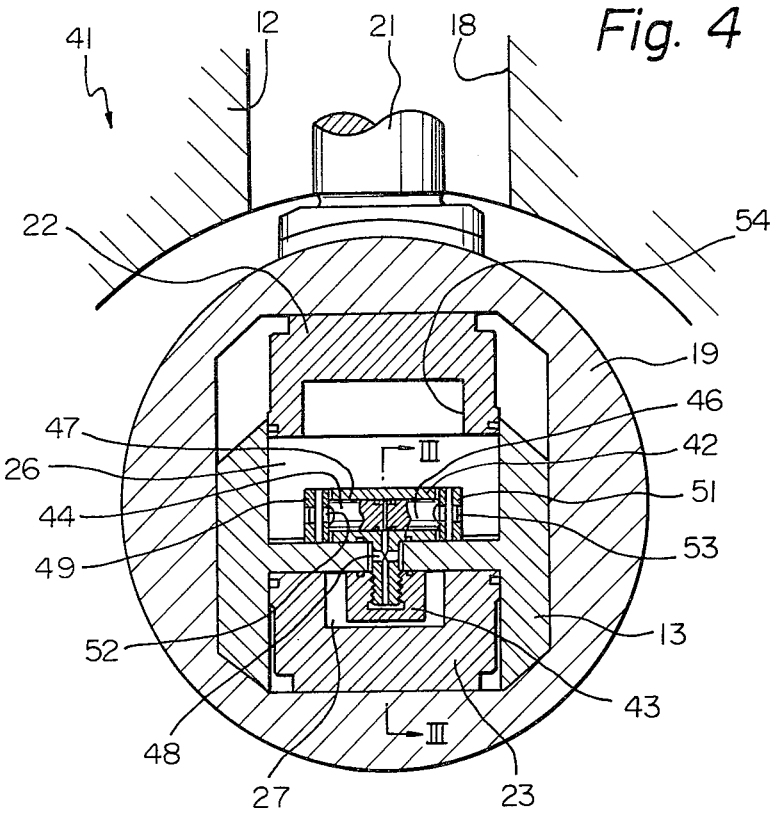
FIG. 4 is a section taken on a line IV—IV of FIG. 3.

Referring now to FIGS. 1 and 2 of the drawing, the prior art radial cylinder hydraulic motor disclosed in U.S. Pat. No. 3,828,400 is illustrated and generally designated by the reference numeral 11. The motor 11 comprises a housing 12 which rotatably supports a shaft 13 by means of bearings 14 and 16. A plurality of drive pistons 17 are sealingly disposed in radial cylinders 18 for radial movement, although only one piston 17 is visible in the drawing. The pistons 17 are circumferentially spaced around the shaft 13 and drivingly engage with an annulus 19 through con rod slippers 21.

The annulus 19 is integrally rotatable with the shaft 13 but movable in the radial direction. First and second pistons 22 and 23 are disposed between the shaft 13 and annulus 19 in diametrically opposed relation and urged away from each other by a spring 24. High pressure hydraulic fluid is selectively applied into one or the other of first and second piston chambers 26 and 27 via passageways 28 and 29 in the housing 12, annular grooves 31 and 32 in the shaft 13 and axial passageways 33 and 34 in the shaft 13.

In operation, high pressure hydraulic fluid is sequentially applied to the cylinders 18 through passageways 36 from a pintle or distributor valve which is not shown. The pressure in the cylinders 18 urges the pistons 17 downwardly to cause rotation of the annulus 19 and shaft 13 through the con rod slippers 21 with a driving force which is proportional to the eccentricity of the annulus 19 which constitutes a crank arm.

When high pressure fluid is applied into the chamber 26, the first piston 22 is urged upwardly as viewed in the drawing. This moves the annulus 19 upwardly and increases the eccentricity thereof relative to the shaft 13. In this position, the motor shaft 13 speed is low and the torque is high.

Applying high pressure fluid into the chamber 27 urges the second piston 23 downwardly along with the annulus 19 and decreases the eccentricity of the annulus to zero or a non-zero lower value. This increases the shaft 13 speed (where the eccentricity is non-zero) and decreases the torque. Where the eccentricity is reduced to zero, the shaft 13 speed is zero and the shaft 13 may free wheel.

As discussed above, the drawback of the prior art motor 11 is that it can only operate at two speeds.

An improved radial cylinder hydraulic motor embodying the present invention which is capable of operating at three speeds is illustrated in FIGS. 3 to 8 and generally designated by the reference numeral 41. Like elements are designated by the same reference numerals used in FIGS. 1 and 2.

A plunger case 42 is mounted on the shaft 13 by means of a nut 43. First and second plungers 44 and 46 are sealingly disposed in a bore 47 of the plunger case 42. High pressure hydraulic fluid may be applied to a space between the facing ends of the plungers 44 and 46 through a longitudinal passageway 48 in the shaft 13. The plungers 44 and 46 are movable toward and away from each other in the horizontal direction as viewed in FIG. 4 which is perpendicular to the direction of movement of the pistons 22 and 23.

Figure 5:
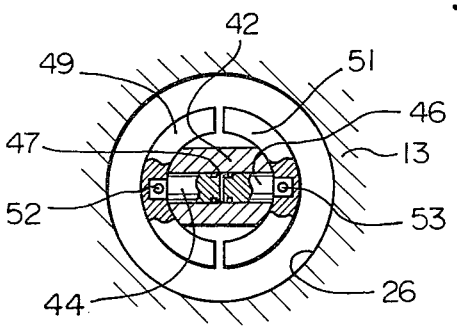
FIG. 5 is an overhead plan view of a piston and shoe arrangement of the present motor.

The outer ends of the plungers 44 and 46 extend outside the plunger case 42 and are fixed to first and second semicircular shoes 49 and 51 by pins 52 and 63 respectively. The radially inner end of the first piston 22 is formed with a circular cutout 54 which has a diameter larger than a diameter of the shoes 49 and 51 when the shoes 49 and 51 are in their radially innermost positions abutting against the plunger case 42 as shown in FIG. 5.

Figure 6:
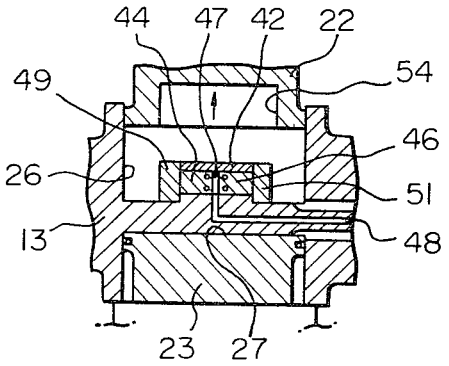
FIGS. 6, 7 and 8 are fragmentary longitudinal sectional views of the present motor in three different respective operating speeds.
Figure 7:
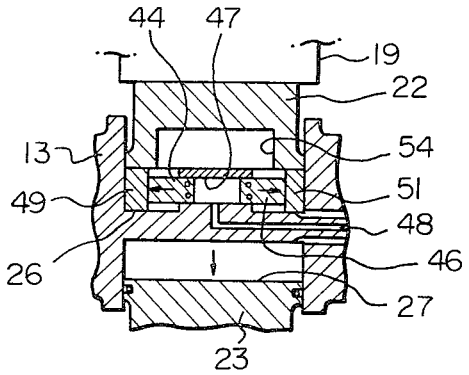
Figure 8:
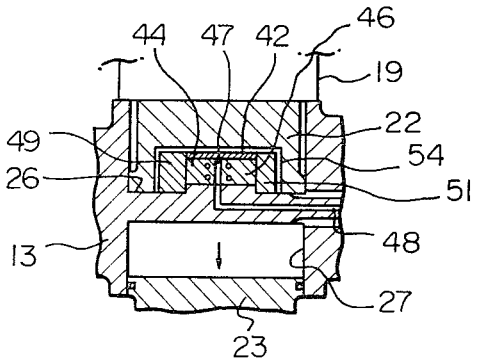

The three operating speeds of the motor 41 are illustrated in FIGS. 6 to 8 respectively. FIG. 6 illustrates a maximum torque, minimum speed condition. In this case, high pressure hydraulic fluid is applied to the chamber 26 to urge the first piston 22 upwardly and move the annulus 19 to the maximum eccentricity position. Low hydraulic pressure is applied to the chamber 27 to disable the second piston 23 and also to the space between the plungers 44 and 46 to retract the plungers 44 and 46.

The condition shown in FIG. 7 is intermediate speed and torque. High pressure is applied to the chamber 27 causing the second piston 23 to move the annulus 19 downwardly. Low pressure is applied to the chamber 26 to disable the first piston 22. High pressure is applied to the bore 47 through the passageway 48 causing the plungers 44 and 46 and thereby the shoes 49 and 51 to move away from each other so that the shoes 49 and 51 abut against the wall of the chamber 26. The periphery or lip of the first piston 22 surrounding the cutout 54 abuts against the shoes 49 and 51, thus preventing further downward movement of the annulus 19 beyond a limit position illustrated in FIG. 7. The intermediate speed is determined by the thickness of the shoes 49 and 51.

The maximum speed, minimum torque condition is shown in FIG. 8. High pressure is applied to the chamber 27 to cause the second piston 23 to move the annulus 19 downwardly. Low pressure is applied to the chamber 26 to disable the first piston 22. Low pressure is applied to the plunger case 42 to retract the shoes 49 and 51. In this position, the shoes 49 and 51 fit inside the cutout 54 and the first piston 22 moves downwardly past the limit position to abut against the shaft 13. It will thus be seen that the shoes 49 and 51 constitute hydraulically controlled stop means.

In summary, it will be seen that the present invention overcomes the drawbacks of the prior art and provides an improved radial cylinder hydraulic motor which is capable of three speed operation with a simple mechanism. Various modifications will become possible for those skilled in the art after receiving the teachings of the present disclosure without departing from the scope thereof. For example, the hydraulically operated shoes may be disposed between the shaft 13 and second piston 23 instead of between the shaft 13 and first piston 22. Furthermore, the number of speeds obtainable in accordance with the present invention is not limited to three. For example, four speeds may be obtained by providing shoes between the shaft 13 and first piston 22 and also between the shaft 13 and second piston 23.

What is claimed is:

1. A radial cylinder hydraulic motor including a shaft, an annulus integrally rotatable with the shaft, first and second pistons disposed between the shaft and the annulus in diametrically opposed relation, a plurality of pistons circumferentially spaced around the annulus in driving relation therewith and hydraulic control means for selectively applying hydraulic pressure to one of the first and second pistons to urge the same away from the shaft and thereby vary an eccentricity of the annulus relative to the shaft, characterized by comprising:

hydraulically actuated stop means disposed between the shaft and the first piston and being movable between a first position for abuttingly preventing movement of the first piston toward the shaft closer than a limit distance from the shaft and a second position for allowing movement of the first piston toward the shaft closer than the limit distance from the shaft.

2. A motor as in claim 1, in which the stop means comprises a stop member which is movable perpendicular to a direction of movement of the first piston.

3. A motor as in claim 1, in which a radially inner end of the first piston is formed with a cutout, the stop means comprising a stop member which fits in the cutout in the second position and abuttingly engages with a portion of the first piston outside of the cutout in the first position.

4. A motor as in claim 1, in which a radially inner end of the first piston is formed with a circular cutout, the stop means comprising a semicircular shoe which fits inside the cutout in the second position and abuttingly engages with a portion of the first piston outside the cutout in the first position.

5. A motor as in claim 1, in which a radially inner end of the first piston is formed with a circular cutout, the stop means comprises a pair of diametrically opposed semicircular shoes which are movable perpendicular to direction of movement of the first piston and hydraulic actuator means for selectively applying high hydraulic pressure and low hydraulic pressure to facing surfaces of the shoes, the shoes, in response to high pressure, moving away from each other to the first position in which a portion of the first piston outside the cutout abuttingly engages with the shoes and, in response to low pressure, moving toward each other to the second position in which the shoes fit inside the cutout.

* * * * *